US006718640B1

(12) United States Patent
John

(10) Patent No.: US 6,718,640 B1
(45) Date of Patent: Apr. 13, 2004

(54) CUTTING TOOL

(75) Inventor: Roger Bernard John, Llanelli (GB)

(73) Assignee: Moving Edge Limited, Barry Vale of Glamorgan (GB)

( * ) Notice: Subject to any disclaimer, the term of this patent is extended or adjusted under 35 U.S.C. 154(b) by 0 days.

(21) Appl. No.: 10/031,249

(22) PCT Filed: Apr. 17, 2000

(86) PCT No.: PCT/GB00/01493

§ 371 (c)(1),
(2), (4) Date: Oct. 30, 2001

(87) PCT Pub. No.: WO00/64646

PCT Pub. Date: Nov. 2, 2000

(30) Foreign Application Priority Data

Apr. 23, 1999 (GB) ..... 9909317

(51) Int. Cl.[7] ..... B26B 1/00; B26B 1/08; B26B 1/10

(52) U.S. Cl. ..... 30/162; 30/151; 30/320; 30/335; 30/351

(58) Field of Search ..... 30/2, 162, 151, 30/351, 320, 30, 335, 336, 169

(56) References Cited

U.S. PATENT DOCUMENTS 4,319,399 A * 3/1982 Ciaffone ..... 30/30 X
5,014,429 A * 5/1991 McNamara ..... 30/162
5,502,896 A * 4/1996 Chen ..... 30/162
6,560,873 B1 * 5/2003 Ortner et al. ..... 30/2

FOREIGN PATENT DOCUMENTS

| | | |
|---|---|---|
| DE | 26 23 490 A1 | 12/1977 |
| DE | G 89 12 929.6 U1 | 2/1990 |
| EP | 0395338 A1 | 10/1990 |
| EP | 0963819 A1 | 12/1999 |
| FR | 2572984 A1 | 5/1986 |
| GB | 1523168 | 8/1978 |
| GB | 1547002 | 6/1979 |
| GB | 2050227 A | 1/1981 |
| GB | 2085790 A | 5/1982 |
| GB | 2232371 A | 12/1990 |

* cited by examiner

*Primary Examiner*—Douglas D. Watts
(74) *Attorney, Agent, or Firm*—Edwin D. Schindler

(57) ABSTRACT

A cutting tool having a blade and a member which is biassed toward a safety position, in which the member forms a guard for the blade, but which may be displaced for exposing the blade by bringing the tool into cutting contact with a workpiece. The cutting tool includes a locking mechanism having a trigger which must be moved from a first position to a second position to release the guard member from its safety position and which is arranged, so that each time the guard member is released from its safety position, it is displaced through a predetermined distance and then returns to its safety position. The guard member will become locked in place regardless of the position of the trigger.

24 Claims, 7 Drawing Sheets

CUTTING TOOL

BACKGROUND OF THE INVENTION

1. Technical Field of the Invention

The present invention relates to a cutting tool.

2. Description of the Prior Art

The majority of existing cutting tools comprise an elongate handle and a blade portion having a cutting edge extending axially from the handle.

When using such a tool to perform a cutting operation, it is usual for a person to grip the handle of the tool and to draw the blade of the tool towards himself or sideways through a workpiece.

However, as the blade of the tool is released from the workpiece at the end of a cut, the person holding the tool often finds it difficult to maintain control of the tool, thus creating a serious safety hazard both to himself and to those around him.

An arrangement has been proposed wherein a tool is provided with a member which is biassed towards a safety position in which the member forms a guard for the blade of the tool, but which may be displaced to expose the blade by bringing the tool into cutting contact with a workpiece. The tool is further provided with a latch which must be released by depressing a trigger to allow the guard member to be displaced. Thus, inadvertent exposure of the blade is prevented.

However, in order to overcome the safety hazard described above, the trigger must be released before the end of a cut to allow the latch to re-engage the guard member as soon as the tool is released from a workpiece: we have found that there is a tendency for persons using such tools not to release the trigger in sufficient time to prevent accidental cuts from occurring.

We have now devised an arrangement which overcomes the above-mentioned limitations of existing cutting tools.

SUMMARY OF THE INVENTION

According to a first aspect of the present invention, there is provided a cutting tool having a blade and a member which is biassed towards a safety position in which the member forms a guard for the blade, but which may be displaced to expose the blade by bringing the tool into cutting contact with a workpiece, and a locking mechanism having a trigger which must be moved from a first position to a second position to release the guard member from its safety position and arranged such that each time the guard member is released from its safety position, is displaced through a predetermined distance, and then returns to its safety position, the guard member will become locked in place regardless of the position of the trigger.

Thus, as the blade of the tool is released from a workpiece at the end of a cut, the guard member is re-deployed and locked in place without the operator having to release the trigger.

Preferably the guard member is pivotally mounted to the tool.

Preferably the locking action of the cutting tool is provided by a strut which is pivotally joined to the guard member, the distal end of the strut being arranged to follow a loop. Most preferably the strut is arranged to pivot in a vertical plane.

Preferably a lug at the distal end of the strut slidably locates within a looped recess. Preferably the recess comprises a guide-channel which extends substantially perpendicularly to the axis of the longitudinal axis of the strut and within which the lug prevents substantial axial movement of the strut. Preferably as the trigger is displaced from said first position to said second position, the strut is displaced such that lug slides out of one end of the channel.

Preferably the locking mechanism is arranged such that the guard member cannot be released from said safety position unless the tool is in contact with the workpiece.

Preferably the blade is provided in a replaceable cartridge.

Cutting tools are also known in which a blade is mounted to a sliding blade-carriage for advancing and retracting the blade in predetermined increments. For example, it is known to form a blade with a number of lines of weakness defining successive blade sections which may be detached, one at a time, from the end of the blade to maintain a sharp edge to the blade. The blade-carriage may therefore be arranged to be advanced in increments equal to the width of each blade segment.

However, in many circumstances, it would be desirable for the blade to be advanced both in predetermined increments, for example as successive sections of the blade are detached, but also for the position of blade to be adjusted by a much finer degree, to control the depth of cut.

We have now devised an arrangement which provides both coarse and fine adjustment of the blade position.

According to a second aspect of the present invention, there is provided a cutting tool having a blade and a sliding blade-carriage formed with an elongate projection which extends substantially perpendicularly through a slot formed in the blade, the projection being rotatable about an axis parallel to its longitudinal axis and the slot being of substantially the same diameter as the projection and extending substantially perpendicularly to the axis of movement of the carriage, so that as the projection is rotated, the blade is correspondingly advanced or withdrawn relative to the carriage.

Thus the carriage may be slid to-and-fro to provide coarse adjustment of the blade position and the elongate projection may be rotated to provide fine adjustment of the blade position.

Preferably the blade is provided in a replaceable cartridge to which the blade-carrier is preferably mounted.

As mentioned above, it is known to provide a cutting tool with a blade formed with a number of lines of weakness defining successive blade sections.

However, in order to detach successive blade sections from the end of the blade it is typically necessary to press the end of the blade sideways against a hard surface to snap the blade along a line of weakness. The blade must therefore be exposed as the end section is detached and, should the cutting tool slip, injury may result. There is also the possibility that the detached blade portion may contaminate a product or cause injury as it is disposed of.

We have now devised an arrangement which overcomes these limitations of existing cutting tools.

According to a third aspect of the present invention, there is provided a cutting tool having a passageway for receiving a elongate blade formed with one or more lines of weakness defining successive blade sections, a portion of the tool being displaceable to detach a distal section of the blade from the remainder of the blade such that the detached blade section is retained within a containment region of the tool.

Preferably the displaceable portion comprises a portion of the passageway formed by opposed first and second walls pivotally mounted such that they may be displaced to one side of the passageway to allow an end section of the blade to be introduced into the gap thus formed, and then brought back into line with the passageway to detach the end section from the remainder of the blade.

Preferably the portion of the passageway formed by the first and second walls is arranged to pivot away from the passageway about the forward edge of the portion.

Preferably, the detached end section of the blade is pressed through an opening into the containment region.

Preferably the passageway is provided in a replaceable blade-cartridge, which may also provide the containment region for receiving detached blade sections.

Preferably the tool or, where the tool comprises a replaceable blade-cartridge, the blade-cartridge, is formed from a blank comprising three collinear elongate portions arranged to be folded together along their adjoining edges such that the passageway for receiving an elongate blade is formed between the opposed faces of two adjacent portions of the blank, and the containment region is formed between the opposed faces of one of the two adjacent portions and a face of the remaining portion.

Preferably the blank is arranged for two adjacent portions of the blank to be folded together, to form the passageway between their opposed faces, and for the portions on opposite sides of the blank to then be folded together, to form the containment region between their opposed faces.

Preferably the blank is formed from a plastics material having fold lines formed by compressed regions of the blank.

Preferably the opposed faces of the two portions which form the containment region are each formed with a plurality of projections for inhibiting movement of detached blade sections within the containment region.

It is known to provide a cutting tool with a replaceable cartridge from which a blade may be extended and retracted. However, such cartridges present a serious safety hazard where it is possible for the blade of the cartridge to be exposed when the cartridge is outside of the tool.

We have now devised an arrangement which overcomes this problem.

According to a fourth aspect of the present invention, there is provided a cutting tool comprising a replaceable blade-cartridge within which a blade is carried such that the blade may be slid from an exposed position to a retracted position and comprising means for preventing the cartridge from being removed from the tool whilst the blade is in its exposed position and means which lock the blade in its retracted position as the cartridge is removed from the tool.

Preferably the tool comprises a blade-carrier and the means for preventing the cartridge from being removed from the tool whilst the blade is in its exposed position comprises a pivoting catch having a first portion which engages a part of the tool body when the blade is in its exposed position, and a second portion which is displaced by the blade-carrier when the blade is in its retracted position to disengage the first portion from said part of the tool body.

Preferably the tool comprises a blade-carrier and the means which lock the blade in its retracted position as the cartridge is removed from the tool comprises a pivoting catch having a first portion which engages the blade-carrier when the blade is in its retracted position and the cartridge is outside of the tool, and a second portion which is displaced by a part of the tool body when the blade is inserted into the tool to disengage the first portion from the blade-carrier.

The arrangement thus significantly reduces the risk of the blade being exposed when the cartridge is outside of the tool.

BRIEF DESCRIPTION OF THE DRAWING FIGURES

Embodiments of the present invention will now be described by way of examples only and with reference to the accompanying drawings, in which.

DETAILED DESCRIPTION OF THE DRAWING FIGURES

Figure 1:
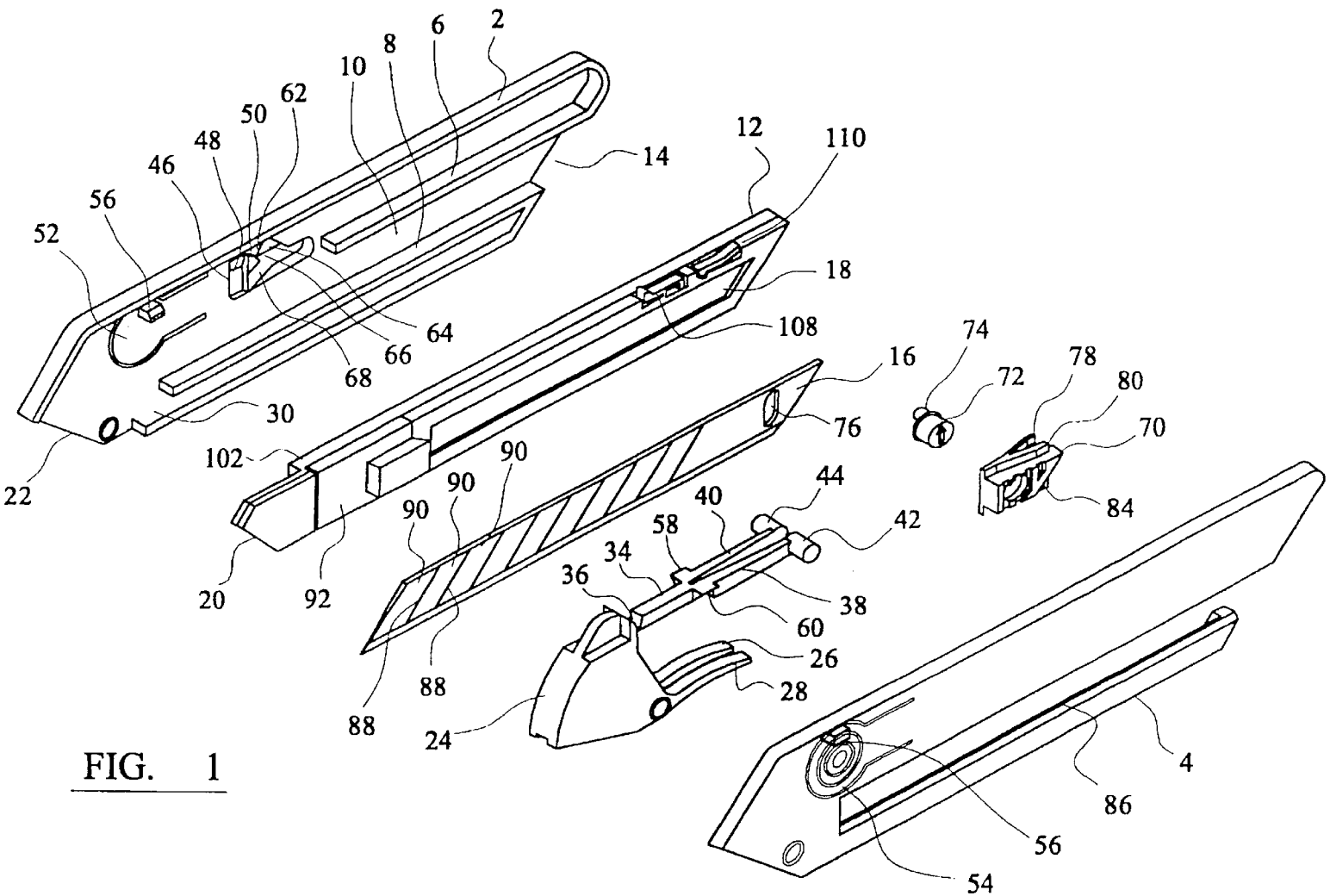
FIG. 1 is a exploded view of the various parts which form a cutting tool in accordance with the present invention.
Figure 2:
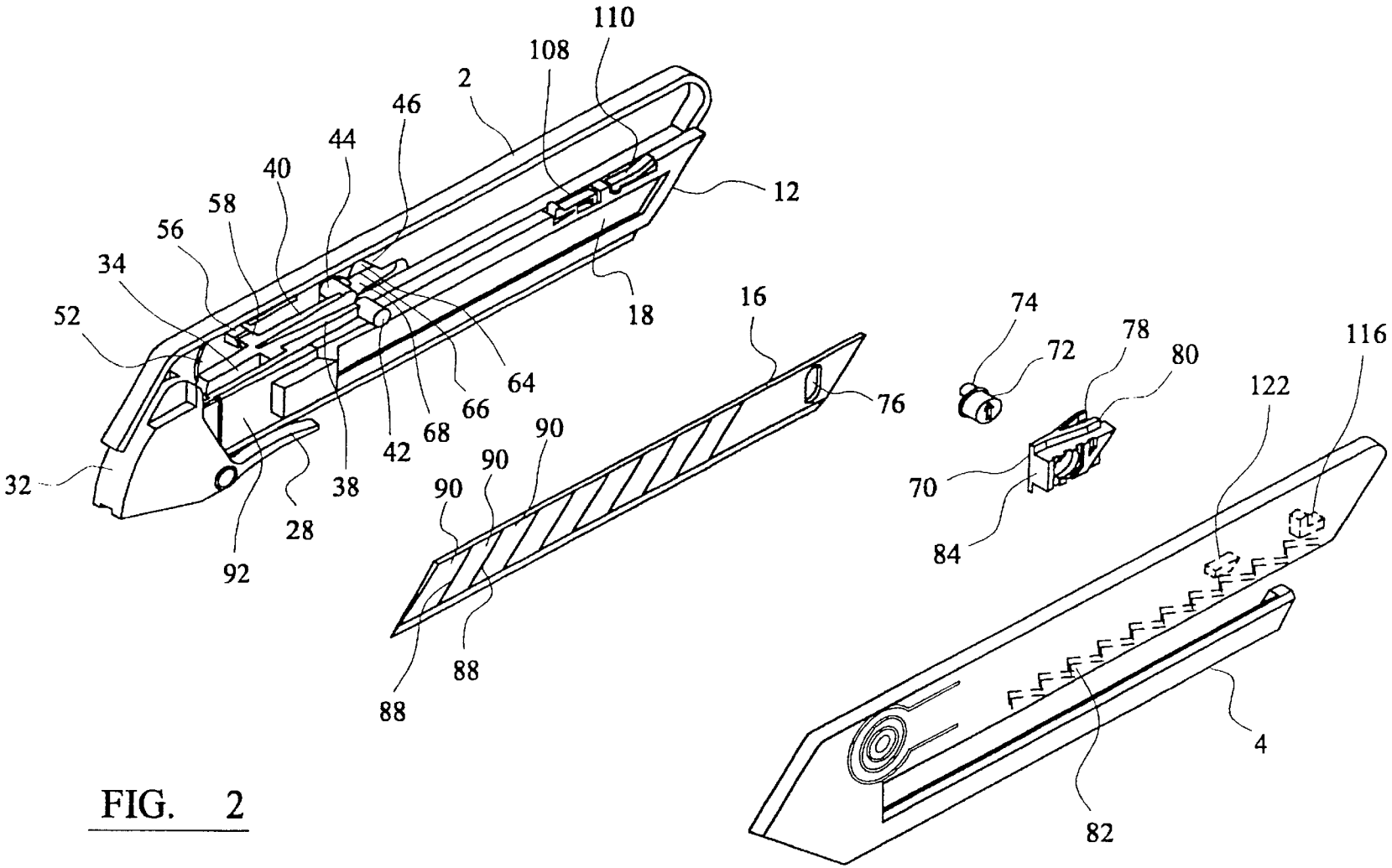
FIG. 2 is a view of a partially assembled cutting tool.
Figure 3:
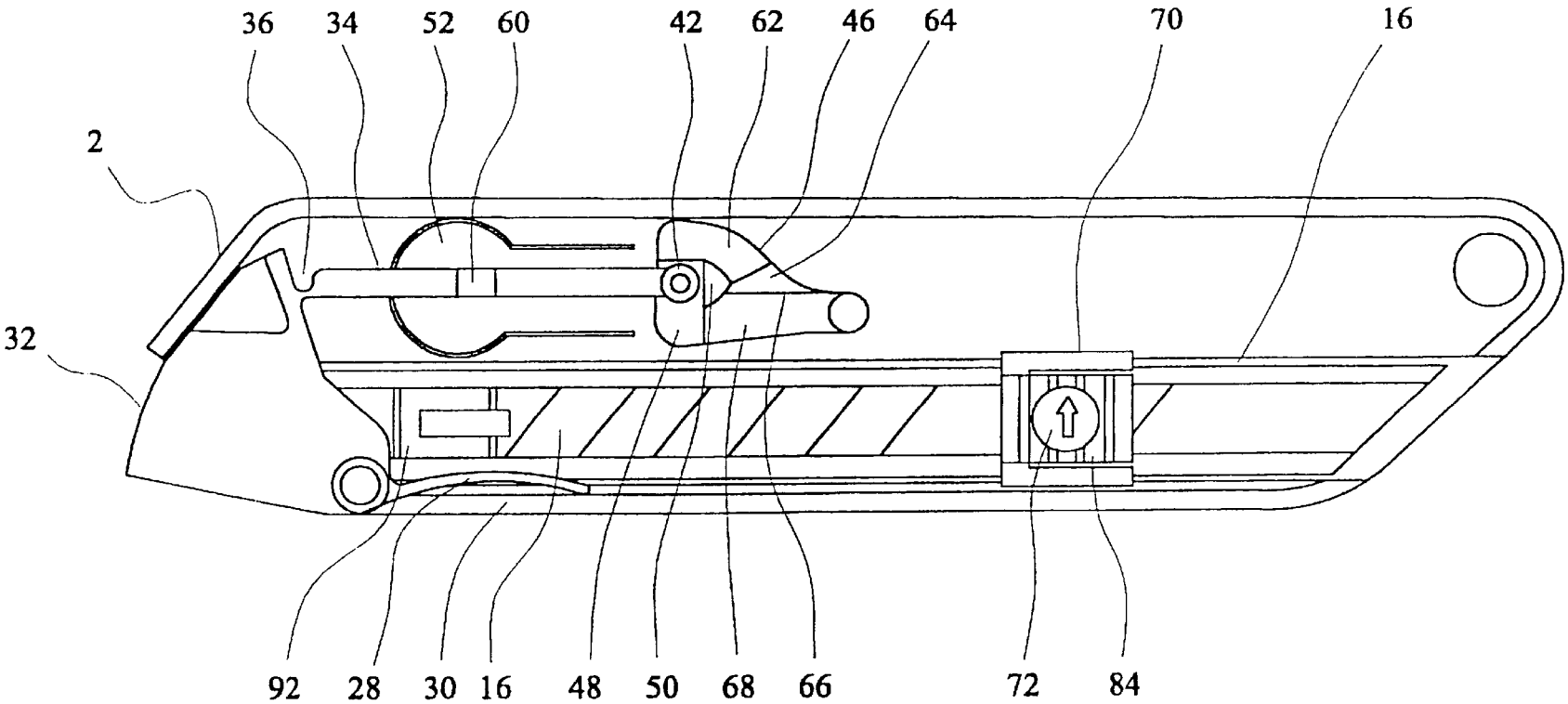
FIG. 3 is a side elevation of a partially assembled cutting tool.

Referring to FIGS. 1 to 3 of the drawings, a cutting tool is shown to comprise a pair of opposed cover plates 2,4, which when brought together provide a handle for the device.

Projections 6,8 formed on the inner surface of each of the cover plates 2,4 provide a passageway 10 which extends longitudinally through the handle for receiving a replaceable blade-cartridge 12, which may be slid into the passageway 10 via an opening 14 formed between the cover plates 2,4 at the rear of the handle.

A blade 16 is contained within the cartridge 12 in a passageway 18 which is closed at its rear end but is formed with an opening 20 at its forward end, through which a limited portion of the blade 16 may be extended, so that, when the cartridge 12 is inserted into the handle, the extended portion will project through an opening 22 at the forward end of the handle.

A guard member 24 is arranged to be pivotally mounted at the forward end of the handle to conceal the extended blade portion of a cartridge 12 inserted into the handle.

The guard member 24 may be spring biassed or, as shown in the drawings, may be formed with a pair of resilient arms 26,28 which, in the assembled device, extend rearwardly into the handle and bear upon the base wall 30 of the handle to bias the guard member 24 such that a portion 32 of the guard member normally projects through the opening 22 at the forward end of the handle, but may be displaced into the handle by pressing the guard member 24 against a workpiece.

A strut 34 is pivotally joined by a thin membrane 36 or may be hinged to the top of the guard member 24 and is bifurcated to provide a pair of resilient arms 38,40, each of which is formed at its distal end with a respective lug 42,44.

The lugs 42,44 are positioned to locate within respective profiled recesses 46 formed in the inner surfaces of the opposed cover plates 2,4.

A guide-channel 48 at the forward end of each profiled recess 46 decreases in depth both upwardly and downwardly away from its midpoint, thereby forming a trough into which a lug 42,44 is normally biassed by its respective arm 38,40. In this position, a buttress 50, to the rear of each lug 42,44, prevents the projecting portion 32 of the guard member 24 from being displaced into the handle.

A pair of triggers for releasing the guard member are provided in the form of respective tongues 52,54 formed in the two cover plates 2,4. By providing triggers on the opposite sides of the handle, the tool may be operated by either left or right-handed persons.

Each tongue 52,54 is formed on its inner surface with a projection 56, which aligns with a corresponding tapered projection 58,60 formed on a respective side of the strut 34. Thus, by pressing upon either of the tongues 52,54, the strut 34 may be deflected upwards to release the guard member 24. With the lugs 42,44 clear of their respective buttresses 50 the projecting portion 32 of the guard member 24 may be displaced into the handle by pressing the guard member 24 against a workpiece.

By displacing the projecting portion 32 of the guard member 24 into the handle, the lugs 42,44 are driven backwards along upper guide-channels 62 of their respective recesses 46. The depth of each recess 46 increases towards the rear of its upper guide-channel 62, across a region 64. An abrupt increase in the depth of each recess 46 at the lower edge 66 of the region 64 defines a lower guide-channel 68 into which the lugs 42,44 are driven by the recoil action of the resilient arms 38,40.

The abrupt increase in the depth of each recess 46 between its upper and lower guide-channels 62,68 ensures oneway travel of the lugs 42,44 around the circuits formed by their respective guide-channels 48,62,68.

As the guard member 24 is released from the workpiece and pivots forwards under the recoil action of the arms 26,28, the lugs 42,44 are drawn forwards along the lower guide-channels 68 of their respective recesses 46. A gradual decrease, followed by an abrupt increase in the depth of each recess 46, towards the forward end of its lower guide-channel 68, ensures that, when the guard member 24 is fully re-deployed, the lugs 42,44 are prevented from returning along the lower guide-channels 68 of their respective recesses 46. The guard member 24 is thus locked in place regardless of whether pressure on the tongues 52,54 has been released.

If pressure is maintained on one or both of the tongues 52,54, whilst the tool is removed from a workpiece, then as that pressure is released, the lugs 42,44 slide upwards into the troughs formed in the guide-channels 48 at the forward ends of their respective recesses 46, under the recoil action of the resilient arms 38,40.

Alternatively, the projections 56 formed on the inner surfaces of the tongues 42,54 and the tapered projections 58,60 of the strut 34 may be arranged such that by pressing upon either of the tongues 52,54, the strut will be deflected downwards (rather than upwards) out of the trough in its respective forward recess 48, to release the guard member 24.

Figure 10:
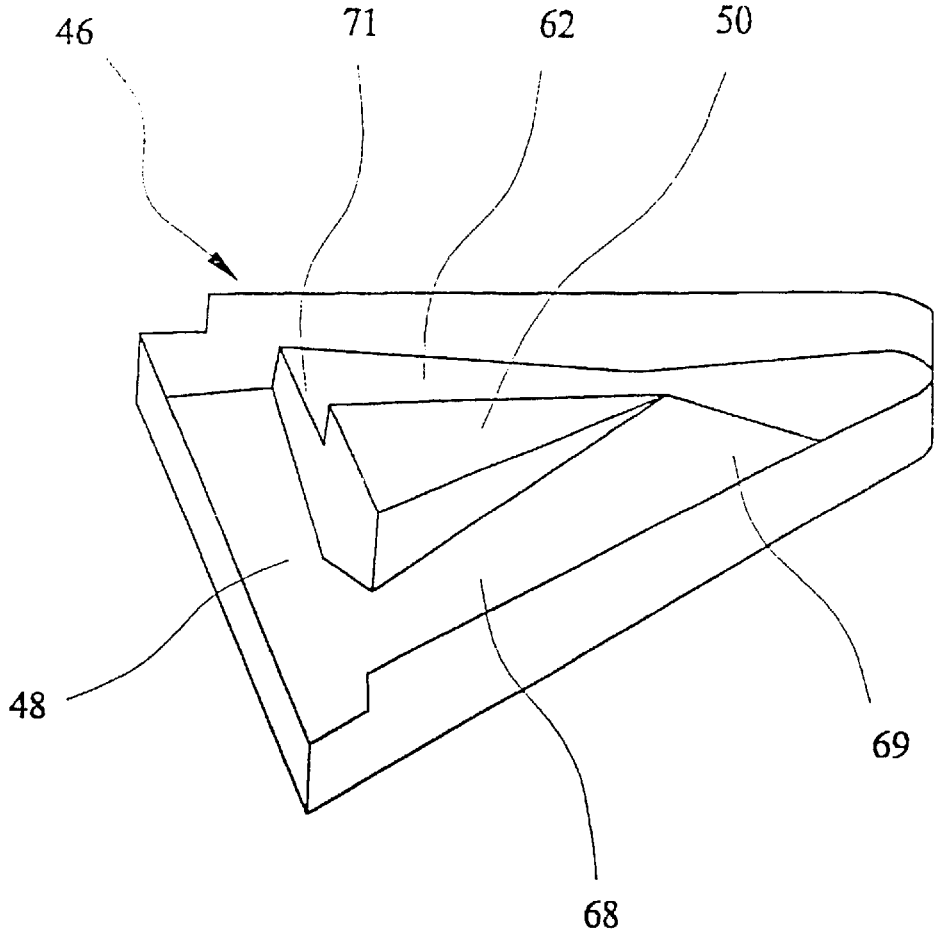
FIG. 10 is a perspective view of a recessed portion of a tool in accordance with the present invention.

In this embodiment, each recess 46 is profiled as shown in FIG. 10 such that by subsequently displacing the projecting portion 32 of the guard member 24 into the handle, by pressing the tool against a workpiece, the lugs 42,44 are driven backwards along the lower guide-channels 68 of their respective recesses 46.

Each of the lower guide-channels 68 decreases in depth towards the rear of its respective recess 46, with an abrupt increase 69 in the depth at the rear of each channel 68 forcing the lugs 42,44 to follow the upper guide-channels 62 of their respective recesses 46 when the tool is released from the surface of a workpiece. The upper guide-channels 62 decrease in depth towards the front of their respective recesses 46, with an abrupt increase 71 in depth at the front of each channel 62 preventing the lugs 42,44 from entering the upper guide-channels 62 when the guard member is fully deployed.

A carriage 70 is mounted to one side of the cartridge 12 by means of a retaining portion (not shown) which locates within the passageway 18. The carriage 70 is provided with a rotatable cylindrical core 72 from which an eccentric axial projection 74 extends across the passageway 18 and though a slot 76 formed in the blade 16. The slot 76 is of substantially the same diameter as the axial projection 74 and extends substantially perpendicularly to the axis of movement of the blade 16, so that as the cylindrical core 72 of the carriage 70 is rotated, the blade 16 is correspondingly advanced or withdrawn by a small distance relative to the carriage 70.

The carriage 70 comprises a resilient portion 78 which, when the cartridge 12 is inserted into the handle, biases a catch 80 into engagement with a corresponding pawl 82 formed in the inner surface of the cover plate 4. A button 84 extends through an elongate slot 86 formed along one side of the cover plate 4 to allow the carriage 70 to be slid backwards and forwards along the cartridge 12 to move the blade 16.

The catch 80 and the opposed indentations which form the pawl 82 are shaped to provide a ratchet action which requires the button 84 to be pressed inwards to allow the blade 16 to be withdrawn into the cartridge 12.

The blade 12 is formed with a number of lines of weakness 88 which define successive blade sections 90, and the cartridge 12 of the present invention provides a convenient means for detaching a blunted section from the forward end of the blade 16 to expose a fresh blade section.

Figure 4:
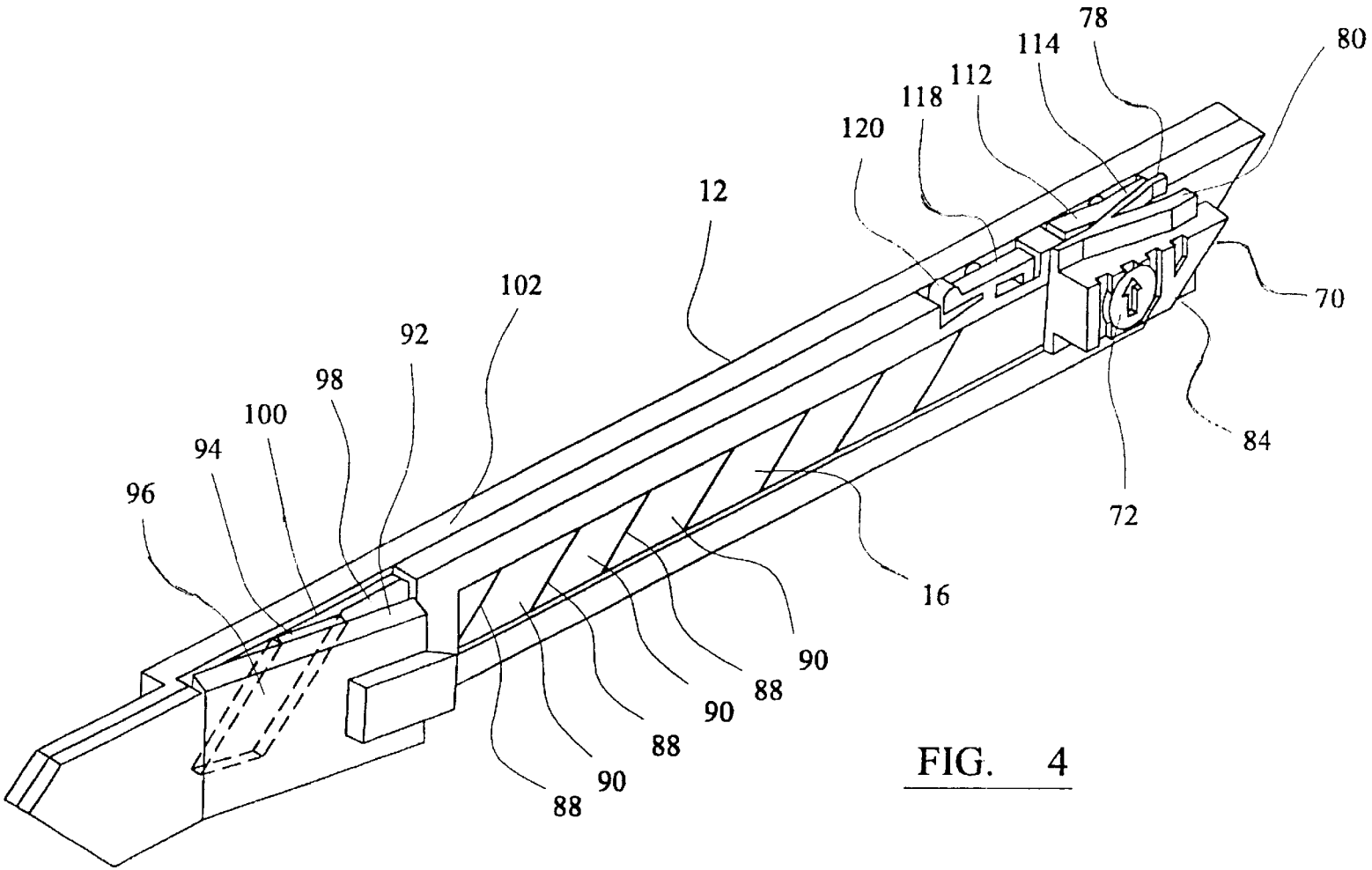
FIG. 4 is a view of a blade-cartridge in accordance with the present invention.

As shown in FIG. 4, with the cartridge 12 removed from the handle and with the blade 16 withdrawn, a portion 92 of the passageway 18 formed by opposed walls 94 and 96 may be pivoted outwards from the cartridge 12 to provide a gap 98. The displacement of the wall 94 also forms an opening 100 leading to a containment region 102 in the rear of the cartridge 12.

Figure 5:
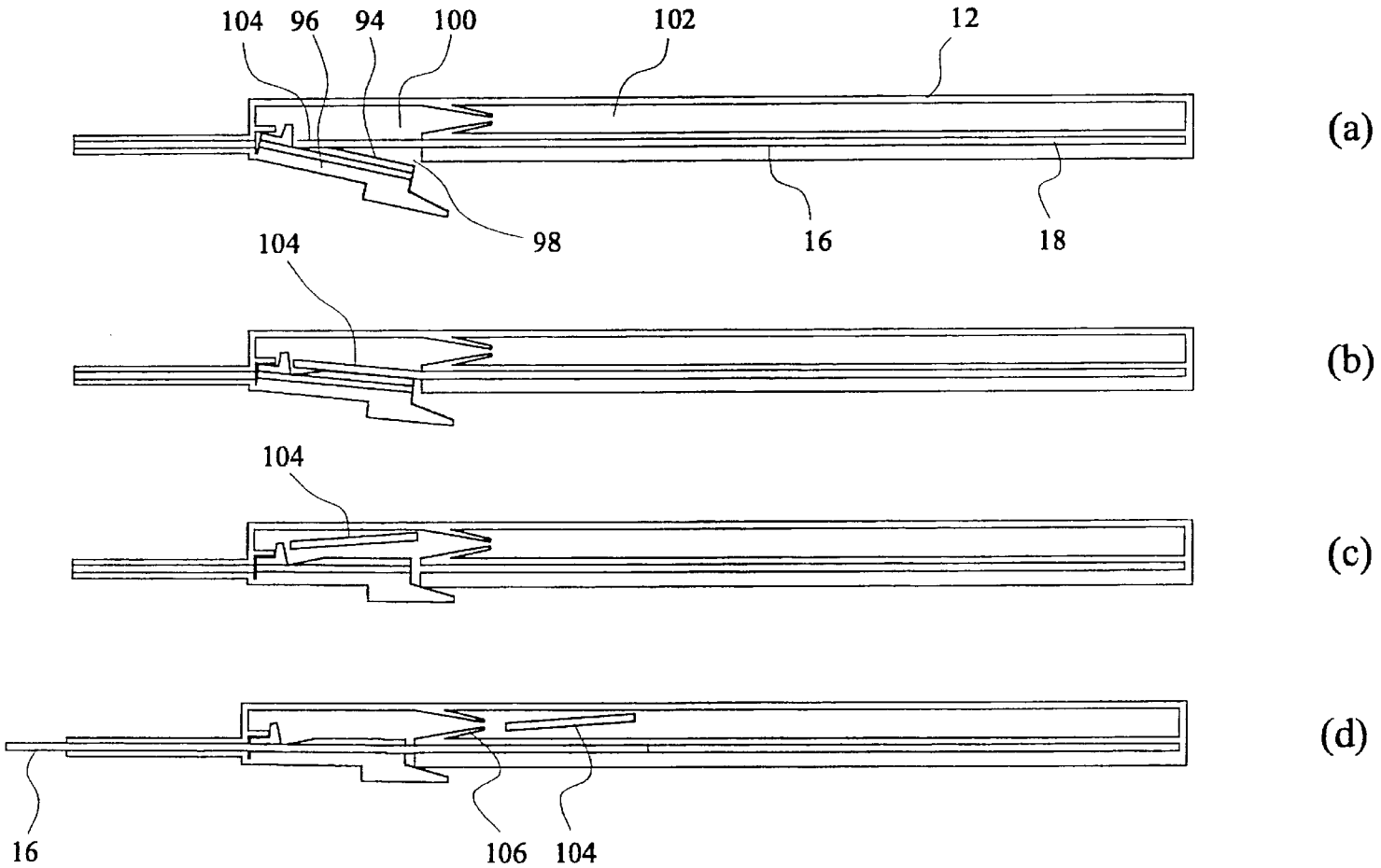
FIG. 5 is a series of sectional plan views showing the sequence of operations for detaching a blade section.
Figure 9:
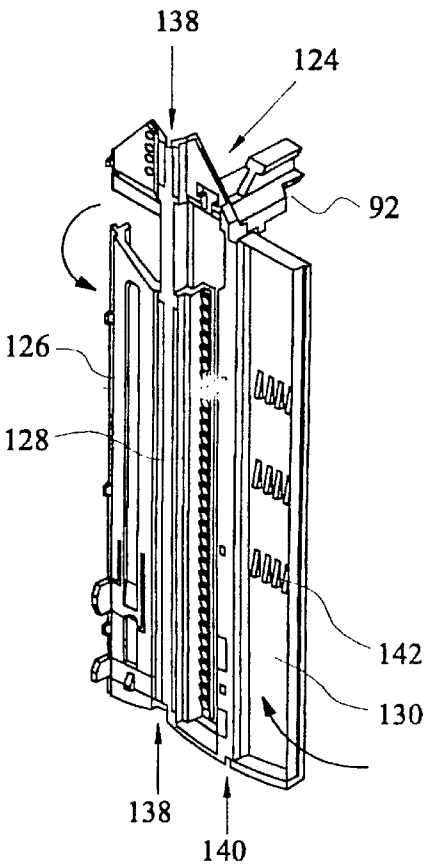
FIGS. 6 to 9 are respectively a top plan view, a side view, a bottom plan view and a perspective view of a blank from which a blade cartridge is formed.
Figure 8:
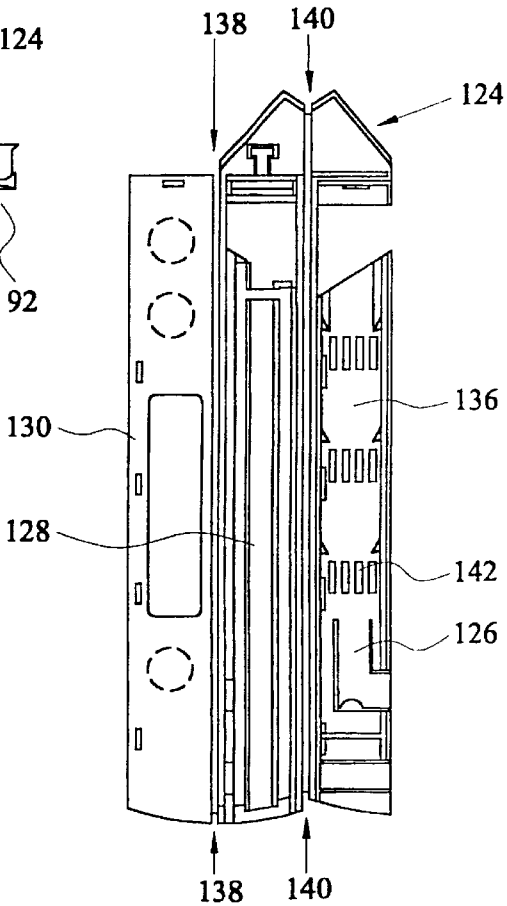
Figure 7:
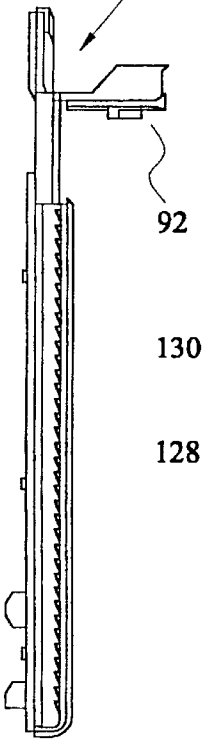
Figure 6:
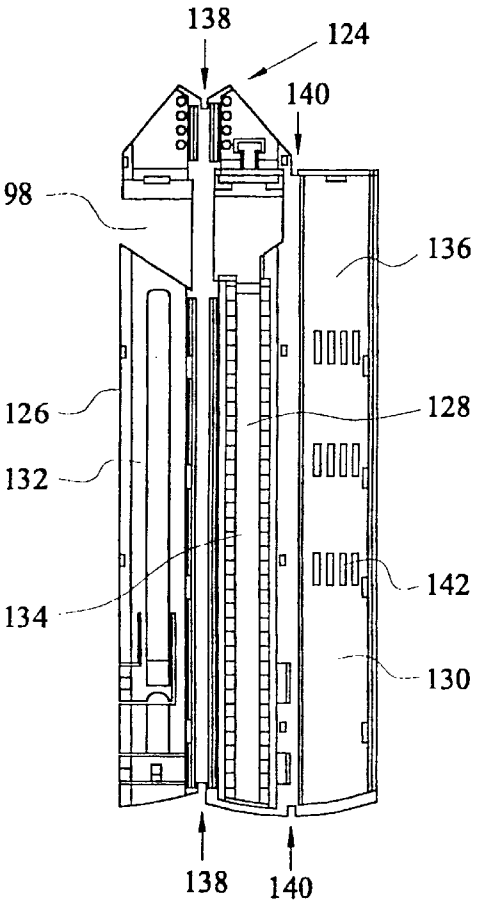

By advancing the blade 16 into the gap 98, as shown in FIG. 5*a*, so that its end section 104 overlies the opening 100 and then pressing the displaced portion 92 of the cartridge 12 back into its normal position, as shown in FIGS. 5*b* and 5*c*, the end section 104 is detached from the remainder of the blade by the wall 94, with the spent section 104 being pressed through the opening 100 and into the containment region 102. The remainder of the blade 16 may then be re-introduced between the walls 94 and 96, as shown in FIG. 5*d*.

Barbs 106 formed on the interior wall of the containment region 102 serve to hold spent blade sections away from the opening 100.

The cartridge 12 is further provided with a pair of pivoting safety catches 108,110. The rearmost catch 110 comprises a downwardly projecting portion 112, which is deflected upwards by the retaining portion of the carriage 70, when the carriage 70 is fully retracted, to retract an upwardly projecting portion 114 of the catch. A recess 116 is formed in the cover plate 4 into which the upwardly projecting portion 114 may extend, when the cartridge 12 is inserted into the handle and the carriage 70 is slid forwards, so that there is no possibility of the cartridge 12 being removed from the handle whilst the blade 16 is exposed.

The foremost catch 108 comprises a downwardly projecting portion 118 which, when the cartridge 12 is removed from the handle acts as a stop against which the retaining portion of the carriage 70 abuts, to prevent the carriage 70 from sliding forwards to expose the blade 16. The catch 108 also comprises and an upwardly projecting portion 120 which, when the cartridge 12 is inserted into the handle, is depressed by a corresponding projection 122 formed in the cover plate 4, thereby raising the downwardly projecting portion 118 of the catch to allow the carriage 70 to slide along the cartridge 12.

The cartridge 12 is formed from a blank 124 comprising a single piece of injection-moulded plastics material as shown in FIGS. 6 to 9. The blank comprises three collinear portions 126,128,130 and is formed into a cartridge by first folding faces 132 and 134 of portions 126 and 128 towards one another, to form a passageway therebetween for receiving a blade, and then folding face 136 of portion 130 towards face 138 of portion. 126, to form a containment region therebetween for receiving detached blade sections though an aperture formed between the passageway and the containment region by a gap 98 in portion 126.

To allow the portions 126,128 and 130 to be readily folded together, a pair of fold-lines 138,140 are preferably pre-formed along the adjoining edges of the portions by compressing those regions of the blank between respective rollers.

When the blank is folded as described above, a plurality of rearwardly inclined projections 142 formed on face 136 of portion 126 and the opposed face 136 of portion 130 prevent detached blade portions, having already fallen away from the aperture formed by gap 98, from returning towards the aperture.

The cutting tool thus described comprises a number of features which make it significantly safer to use than existing tools.

What is claimed is:

1. A cutting tool comprising a blade and a member which is biassed towards a safety position in which the member forms a guard for the blade, but which may be displaced to expose the blade by bringing the tool into cutting contact with a workpiece, and a locking mechanism having a trigger which must be moved from a first position to a second position to release the guard member from its safety position and arranged such that each time the guard member is released from its safety position, the guard member is displaced through a predetermined distance, and then returns to its safety position, the guard member will become locked in place regardless of the position of the trigger.

2. A cutting tool as claimed in claim 1, wherein the guard member is pivotally mounted to the tool.

3. A cutting tool as claimed in claim 1, wherein the locking action of the cutting tool is provided by a strut which is pivotally joined to the guard member, the distal end of the strut being arranged to follow a loop.

4. A cutting tool as claimed in claim 3, wherein the strut is arranged to pivot in a vertical plane.

5. A cutting tool as claimed in claim 3, wherein a lug at the distal end of the strut slidably locates within a looped recess.

6. A cutting tool as claimed in claim 5, wherein the recess comprises a guide-channel which extends substantially perpendicularly to the axis of the longitudinal axis of the strut and within which the lug prevents substantial axial movement of the strut.

7. A cutting tool as claimed in claim 6, arranged such that as the trigger is displaced from said first position to said second position, the strut is displaced such that the lug slides out of one end of the channel.

8. A cutting tool as claimed in claim 1, wherein the locking mechanism is arranged such that the guard member cannot be released from said safety position unless the tool is in contact with the workplace.

9. A cutting tool as claimed in claim 1, wherein the blade is provided in a replaceable cartridge.

10. A cutting tool comprising a blade and a sliding blade-carriage formed with an elongate projection which extends substantially perpendicularly through a slot formed in the blade, the projection being rotatable about an axis parallel to its longitudinal axis and the slot being of substantially the same diameter as the projection and extending substantially perpendicularly to the axis of movement of the carriage, so that as the projection is rotated, the blade is correspondingly advanced or withdrawn relative to the carriage.

11. A cutting tool as claimed in claim 10, wherein the blade is provided in a replaceable cartridge.

12. A cutting tool as claimed in claim 11, wherein the blade-carrier is mounted to the replaceable cartridge.

13. A cutting tool, comprising:

a passageway for receiving an elongate cutting blade formed with at least one line of weakness defining successive blade sections;

a displaceable portion having a first wall and a second wall with said first wall and said second wall being opposed to one another and forming a portion of said passageway, said first wall and said second wall being pivotally mounted for displacement to one said of said passageway for forming a gap in said passageway, enabling an end section of said elongate cutting blade to be introduced into said gap, said displaceable portion being then returnable into line with said passageway for detaching said end section of said elongate cutting blade from a remainder of said elongate cutting blade; and, a containment region for retaining said end section of said elongate cutting blade following said detaching of said end section.

14. A cutting tool as claimed in claim 13, wherein the portion of the passageway formed by the first and second walls is arranged to pivot away from the passageway about the forward edge of the portion.

15. A cutting tool as claimed in claim 13, wherein the detached end section of the blade is pressed through an opening into the containment region.

16. A cutting tool as claimed in claim 13, wherein the passageway is provided in a replaceable blade-cartridge.

17. A cutting tool as claimed in claim 16, wherein the replaceable blade carriage also provides the containment region for receiving detached blade sections.

18. A cutting tool as claimed in claim 13, wherein the tool or, where the tool comprises a replaceable blade-cartridge, the blade-cartridge, is formed from a blank comprising three collinear elongate portions arranged to be folded together along their adjoining edges such that the passageway for receiving an elongate blade is formed between the opposed faces of two adjacent portions of the blank, and the containment region is formed between the opposed faces of one of the two adjacent portions and a face of the remaining portion.

19. A cutting tool as claimed in claim 18, wherein the blank is arranged for two adjacent portions of the blank to be folded together, to form the passageway between their opposed faces, and for the portions on opposite sides of the blank to then be folded together, to form the containment region between their opposed faces.

20. A cutting tool as claimed in claim 18, wherein the blank is formed from a plastic material having fold lines formed by compressed regions of the blank.

21. A cutting tool as claimed in claim 18, wherein the opposed faces of the two portions which form the containment region are each formed with a plurality of projections for inhibiting movement of detached blade sections within the containment region.

22. A cutting tool comprising a replaceable blade-carriage within which a blade is carried such that the blade may be slid from an exposed position to a retracted position and comprising means for preventing the cartridge from being removed from the tool while the blade is in its exposed position and means for locking the blade in its retracted position as the cartridge is removed from the tool.

23. A cutting tool as claimed in claim 22, comprising a blade-carrier and wherein the means for preventing the cartridge from being removed from the tool while the blade is in its exposed position comprise a pivoting catch having a first portion which engages a part of the tool body when the blade is in its exposed position, and a second portion which is displaced by the blade-carrier when the blade is in its retracted position to disengage the first portion from said part of the tool body.

24. A cutting tool as claimed in claim 22, comprising a blade-carrier and wherein the means which lock the blade in its retracted position as the cartridge is removed from the tool comprise a pivoting catch having a first portion which engages the blade-carrier when the blade is in its retracted position and the cartridge is outside of the tool, and a second position which is displaced by a part of the tool body when the blade is inserted into the tool to disengage the first portion from the blade-carrier.

* * * * *

US006718640C1

(12) INTER PARTES REEXAMINATION CERTIFICATE (0321st)

United States Patent

John

(10) Number: US 6,718,640 C1

(45) Certificate Issued: Nov. 22, 2011

(54) CUTTING TOOL

(75) Inventor: Roger Bernard John, Llanelli (GB)

(73) Assignee: Spellbound Development Group, Inc., Irvine, CA (US)

Reexamination Request:
No. 95/001,441, Oct. 7, 2010

Reexamination Certificate for:

| | |
|---|---|
| Patent No.: | **6,718,640** |
| Issued: | **Apr. 13, 2004** |
| Appl. No.: | **10/031,249** |
| Filed: | **Oct. 30, 2001** |

(22) PCT Filed: Apr. 17, 2000

(86) PCT No.: PCT/GB00/01493

§ 371 (c)(1), (2), (4) Date: Oct. 30, 2001

(87) PCT Pub. No.: WO00/64646

PCT Pub. Date: Nov. 2, 2000

(51) Int. Cl.

| | |
|---|---|
| ***B26B 1/00*** | (2006.01) |
| ***B26B 1/08*** | (2006.01) |
| ***B26B 1/10*** | (2006.01) |

(52) U.S. Cl. ..... 30/162; 30/151; 30/320; 30/335; 30/351

(58) Field of Classification Search ..... 30/286
See application file for complete search history.

(56) References Cited

To view the complete listing of prior art documents cited during the proceeding for Reexamination Control Number 95/001,441, please refer to the USPTO's public Patent Application Information Retrieval (PAIR) system under the Display References tab.

*Primary Examiner*—Robert M. Fetsuga

(57) ABSTRACT

A cutting tool having a blade and a member which is biassed toward a safety position, in which the member forms a guard for the blade, but which may be displaced for exposing the blade by bringing the tool into cutting contact with a workpiece. The cutting tool includes a locking mechanism having a trigger which must be moved from a first position to a second position to release the guard member from its safety position and which is arranged, so that each time the guard member is released from its safety position, it is displaced through a predetermined distance and then returns to its safety position. The guard member will become locked in place regardless of the position of the trigger.

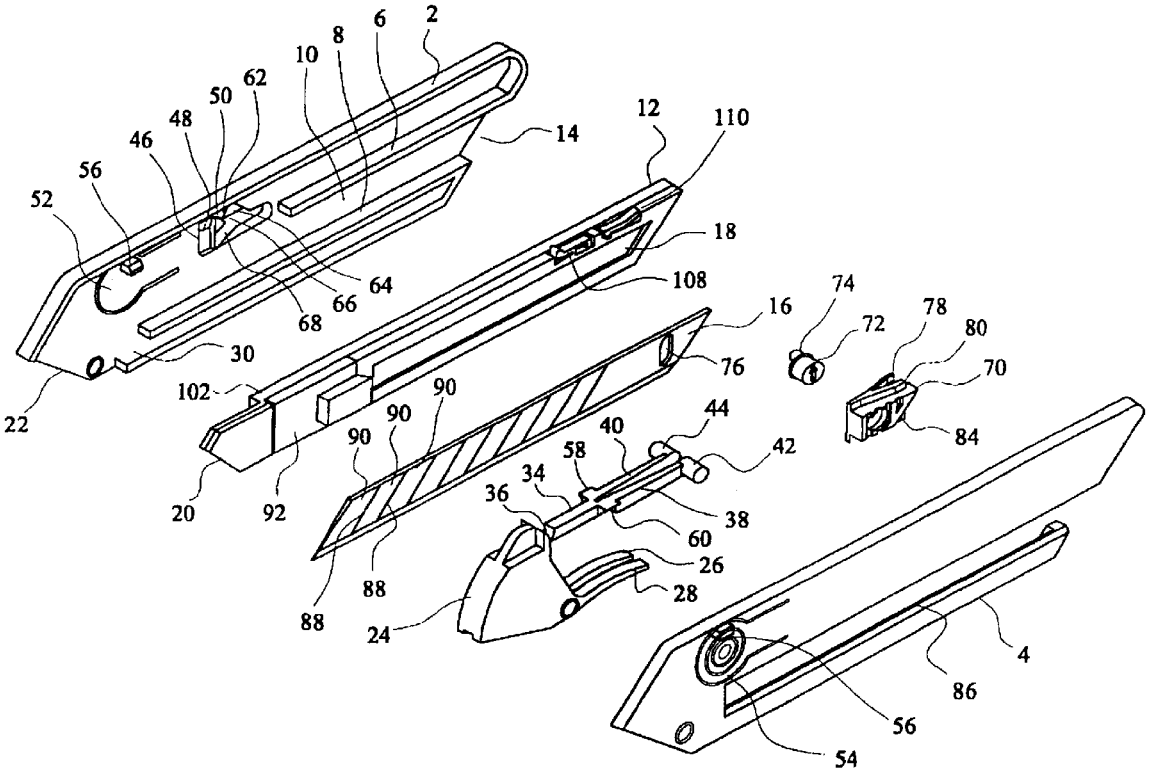

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 8 are cancelled.

New claims 25-27 are added and determined to be patentable.

Claims 3-7 and 9-24 were not reexamined.

*25. A cutting tool, comprising:*

*a blade;*

*a guard member which is biassed towards a safety position in which the guard member covers the blade, but*

*which may be displaced to expose the blade by bringing the tool into cutting contact with a workpiece;*

*a locking mechanism comprising:*

*a strut hinged to the guard member;*

*a buttress which normally prevents the guard member from being displaced by blocking movement of the strut; and*

*a trigger which must be moved from a first position to a second position to move the strut and cause the strut to clear the buttress such that the guard member may be released from its safety position;*

*said locking mechanism arranged such that each time the guard member is released from its safety position to expose the blade, the guard member is displaced through a predetermined distance, and then returns to its safety position, where the guard member will become locked in place regardless of the position of the trigger.*

*26. The cutting tool of claim 25 wherein, a trigger projection engages a strut projection to deflect the strut relative to the buttress.*

*27. The cutting tool of claim 26 wherein, the strut projection is tapered.*

* * * * *